United States Patent [19]

Von Mosshaim

[11] 4,425,929

[45] Jan. 17, 1984

[54] COLLAPSIBLE STRUCTURE

[76] Inventor: Horst E. Von Mosshaim, P.O. Box 6641, Newport News, Va. 23606

[21] Appl. No.: 247,859

[22] Filed: Mar. 26, 1981

[51] Int. Cl.[3] ..... A45F 1/16

[52] U.S. Cl. ..... 135/102; 135/116; 135/120; 135/109; 52/63

[58] Field of Search ..... 52/63, 64, 66; 135/DIG. 1, 4 R, 7.1 R, 1 A, 102, 116, 120, 109

[56] References Cited

U.S. PATENT DOCUMENTS

| | | | |
|---|---|---|---|
| 609,553 | 8/1898 | Lloyd | 135/4 R |
| 1,126,236 | 1/1915 | Lees . | |
| 1,143,774 | 6/1915 | Nicholls . | |
| 2,571,362 | 10/1951 | Hervey . | |
| 2,858,837 | 11/1958 | Harper . | |
| 2,960,993 | 11/1960 | Holmstrom | 135/7.1 R |
| 2,992,649 | 7/1961 | Swallow . | |
| 3,036,583 | 5/1962 | Miller . | |
| 3,171,417 | 3/1965 | Stokes . | |
| 3,399,686 | 9/1968 | Horton | 135/1 A |
| 3,463,174 | 8/1969 | Heller . | |
| 3,513,861 | 5/1970 | Johnson . | |
| 3,534,512 | 10/1970 | Ballas . | |
| 3,563,257 | 2/1971 | Cummins . | |
| 3,703,311 | 11/1972 | Davis | 135/1 A |
| 3,802,450 | 4/1974 | Huddle . | |
| 3,892,094 | 7/1975 | Spray . | |
| 3,906,968 | 9/1975 | Black | 135/DIG. 1 |
| 4,069,833 | 1/1978 | Johansson . | |
| 4,084,599 | 4/1978 | Matthews . | |
| 4,227,542 | 10/1980 | Bonfilio | 135/DIG. 1 |

FOREIGN PATENT DOCUMENTS

| | | | |
|---|---|---|---|
| 243494 | 2/1963 | Australia | 135/102 |
| 311090 | 2/1919 | Fed. Rep. of Germany | 135/DIG. 1 |
| 1026655 | 4/1953 | France | 135/102 |
| 862011 | 3/1961 | United Kingdom | 52/63 |

*Primary Examiner*—Price C. Faw, Jr.
*Assistant Examiner*—Richard E. Chilcot, Jr.
*Attorney, Agent, or Firm*—Steele, Gould & Fried

[57] ABSTRACT

A collapsible structure useful for such applications as a portable garage, greenhouse, camping or camouflage covering comprises a pair of hub members detachably connected to one another by hub connector and a plurality of spring-steel joist members pivotally mounted in the hubs and serving to support a stretched skin thereover. The structure is held stably in either open or closed position by the combination of a Landau-type locking mechanism and a sheathed spring.

8 Claims, 7 Drawing Figures

COLLAPSIBLE STRUCTURE

BACKGROUND OF THE INVENTION

1. Field of the Invention

This invention relates to the field of collapsible structures for such applications as portable garages, greenhouses, military camouflage coverings and tents. The structure is intended to be conveniently assemblable, yet strong enough to stand up to rough handling and long use in exposed locations.

2. Description of the Prior Art

The prior art discloses a number of inventions related to collapsible structures. In addition to tent structures, such diverse applications as baby carriages, umbrellas, aircraft hangers, automobile covers and folding corridors employ skin members stretched over rib members. These structures each attempt to deal with the common problems of providing a lightweight, conveniently assemblable yet strong structure. Prior art structures may be divided into categories according to the method of supporting joist members which in turn suppport the flexible skin. For example, support members may be connected rigidly or pivotally, on an axis or along a sliding track. The present invention supports rib or joist members pivotally at equally spaced locations around hub members located at either side of the unit.

A second characteristic for comparison of prior art structures is the method of holding the joist and skin assembly in an open or closed position. The covering skin is often flexible, e.g. plastic, and will itself provide a certain amount of tension, for holding the structure in position. This scheme is used for tent structures and umbrellas. As applied to automobile coverings, the flexible skin is often stretched over the vehicle and attached under tension to the bumpers at either end. In addition, a number of locking schemes are disclosed by the prior art. Non-extensible members may be connected between joist members to secure the joist members at spaced intervals over which the skin is stretched. The present invention solves the locking problem by providing a combination spring/locking mechanism which is stable either in an open or closed position. Although a springy skin may be employed, a less-extensible, heavy duty fabric is preferred.

The present invention employs the advantages of the prior art's flyweight tent structures as well as the advantages of the more substantial building-like structures. The present invention comprises a substantial structure, yet one which is conveniently assembled, disassembled and transported. The construction is simple yet strong, and is particularly suited to long term installation in exposed areas.

SUMMARY OF THE INVENTION

It is an object of this invention to provide a semipermanent collapsible structure useful for such applications as a garage, a tent, a pool covering, a camouflage covering or a general purpose shelter.

It is also an object of this invention to provide a simple structure which may be assembled and disassembled using a minimum of hardware.

It is another object of this invention to provide a substantial structure which is capable of supporting a heavy fabric for long term use, yet is easily manipulated for transport and assembly.

It is yet another object of this invention to provide a structure which tends to remain open when opened and remain closed when closed, notwithstanding the action of wind.

These and other objects of this invention are provided by a collapsible enclosure comprising two central hub flanges rigidly and detachably interconnectable via hub connectors defining the width of the enclosure; a plurality of joist members pivotally mounted in joist holes spaced around the periphery of said hub flanges, said plurality of joist members comprising an inner support joist and two outer support joists; a locking mechanism comprising at least one locking arm pivotally connecting said inner support joist and one of said outer support joists, said locking arm having an inner leg pivotal on said inner support joist, an outer leg pivotal on one of said outer support joists and a locking flange pivotable on both said inner leg and outer leg, said legs being pivotable only in one direction; an extensible spring-like member attached to and urging said inner support joist and one of said outer support joists toward one another; and, a covering skin stretchable over said joist members and attached to said joist members at spaced points along said skin.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

DETAILED DESCRIPTION OF THE PREFERRED EMBODIMENT

Figure 1:
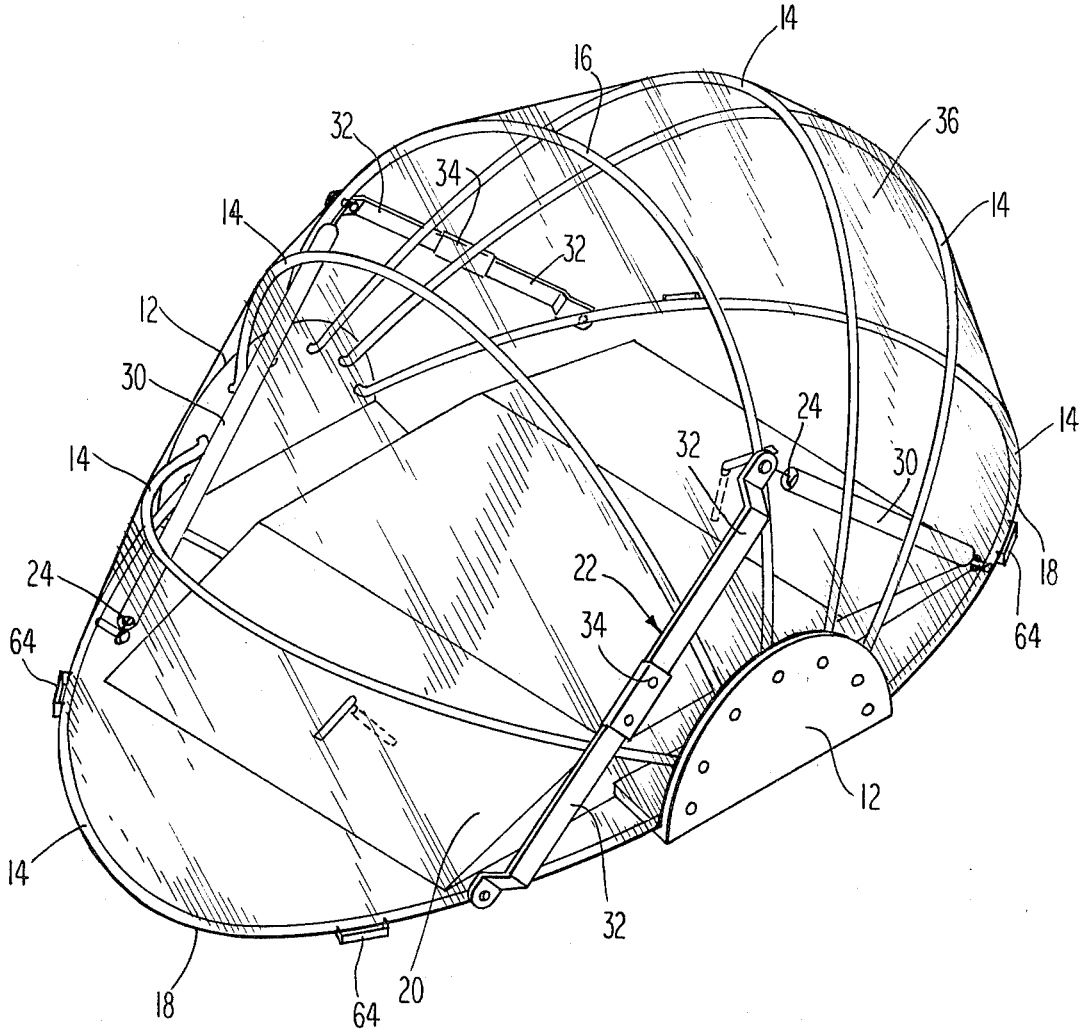
FIG. 1 is a perspective view of the structure of this invention comprising a transparent covering skin exposing the inner members.

The structure of this invention is shown in a closed position in FIGS. 1–4. Transparent skin 36 allows viewing of the internal mechanisms. The structure comprises hub flanges 12 rigidly but detachably connected via hub connectors 61. Joist members 14, 16, 18 pivot in holes equally spaced along the periphery of hubs 12. Central or inner joist 16 and end joists 18 are urged together by springs 24, but are held apart by Landau-type locking mechanisms 22. Handles 64, attached to end joists 18, allow the user to conveniently open or close the structure as described herein. A three piece platform member dimensioned to closely and securely overfit hub flanges 12 and hub connectors 61 secures the structure and provides a floor surface.

Figure 2:
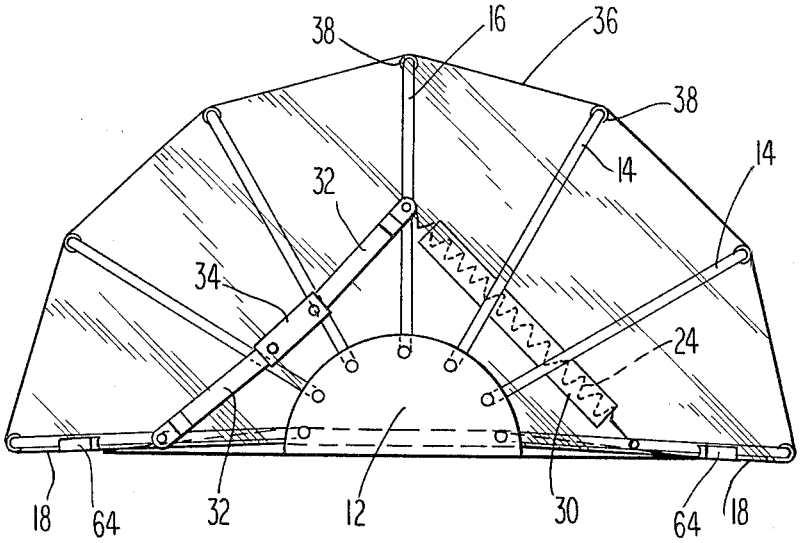
FIG. 2 is a side elevation of the structure of this invention, also having a transparent skin.

FIG. 2 depicts the structure in side elevation. The structure is generally shaped like half of an oblate spheroid (formed by rotation of an ellipse about its minor axis), providing minimum wind resistance both from the sides and ends. The unique rounded shape, not unlike an igloo, is a result of the equally spaced joist members which pivot at spaced points in a semi-circular arc, allowing wind passing over the structure to exert a downward force, thereby holding the enclosure in position. The user need not align the structure with regard to the prevailing wind. Nor will the wind tend to open the structure when closed or close it when opened, because the interaction of locks 22 and springs 24 results in a bistable structure.

The covering skin 36 is supported by joists 14, 16, 18, but only central joist 16 and end joists 18 are directly connected to the locking mechanisms 22 and springs 24. The joists are, however, directly connected to skin 36. The joists may be sewn to skin 36 by looping fibers around the joists and through the skin. For optimum waterproofing, it is preferred that the joists be inserted through loops 38 which are affixed to skin 36 by gluing. Alternatively, skin 36 may be assembled in sewn segments, joists 14, 16, 18 being inserted in the hems provided at each junction between segments.

The material chosen for skin 36 will depend on the function contemplated for the structure. Skin 36 is depicted herein as transparent material, e.g. plastic, for easy viewing of the internal workings. Such a material would be useful for a greenhouse. In a structure for use as a garage, the transparent material conveniently allows light through skin 36 for user convenience while engaged in mechanical repairs, etc.. A tent structure or camouflage covering would employ opaque or translucent material. In the preferred embodiment, a strong opaque vinyl material such as that sold under the trademark Naugahide is preferred for maximum durability. A lighting means (not pictured) may be mounted on central joist 16 or hub flanges 12, operable by means of limit switches when the enclosure is opened, or by other convenient switch means.

Figure 3:
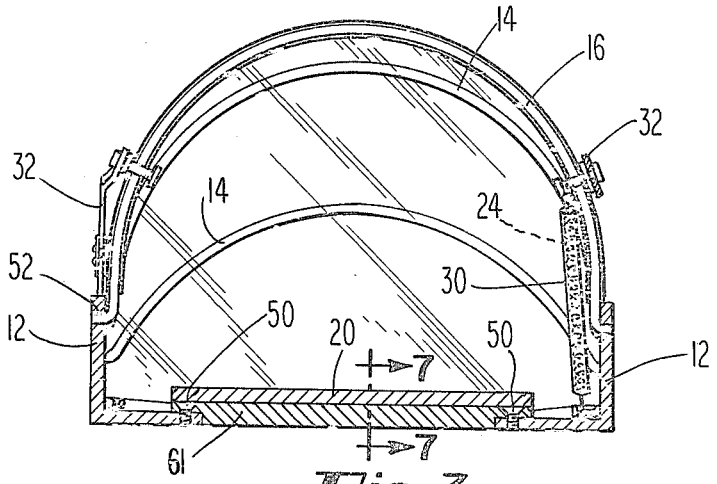
FIG. 3 is a section view taken along the line 3—3 in FIG. 4.
Figure 4:
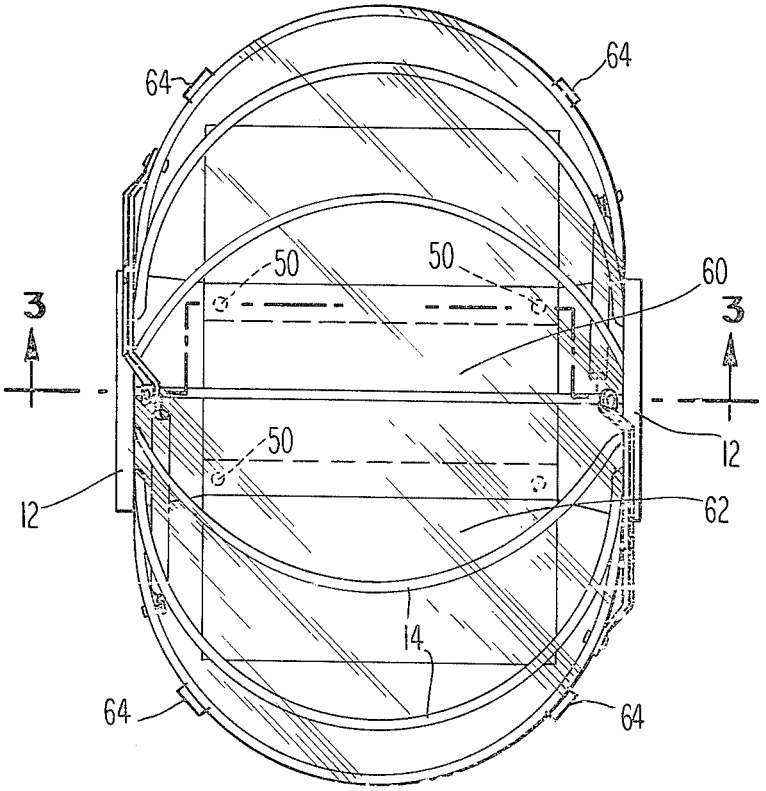
FIG. 4 is a top view of the structure of this invention, as seen through the transparent skin.

With reference to FIG. 3, hub flanges 12 are held at the proper spacing by at least one hub connector which may also function as a floor member. It will be appreciated that a garage enclosure requires a wide platform while a greenhouse requires minimum width flooring members corresponding to platform 20. Thus, the intended use will dictate whether a full platform is needed, or whether relatively thin hub spacing members are needed. It is presently preferred that thin hub spacing members be used even where a full platform is to be mounted thereupon. In this manner, the same structure can be used for both functions.

Joists 14 are constructed of spring-steel, rather than a tubular metal. The spring-steel joist members are prebent to a curvature slightly less than that required in the assembled unit whereby the outward-turned pivoting ends 52 are springingly held in the pivot holes in hub flanges 12. Upon assembly, the joist members are compressed and inserted into the holes along the periphery of hubs 12. The curved ends 52 of joists 14, 16, 18 thus fit pivotally but securely into the hub flanges 12, allowing free pivotal motion. Use of solid spring-steel joists rather than hollow tubular joists allows for longer wear and greater strength. The joists are solid flat steel bands rather than hollow tubes. The unit is therefore attractive and lightweight, without sacrificing strength.

Figure 7:
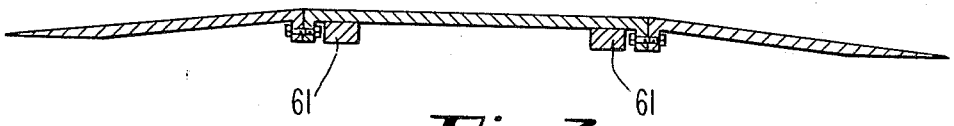
FIG. 7 is a section view of the structure of the platform and connecting members, taken along line 7—7 in FIG. 3.

FIGS. 3 and 7 detail the construction of the platform base 20. The preferred platform is constructed in three sections, a center section 60 and two end sections 62. The center section encloses the hub connecting members, and is dimensioned to closely overfit the hub connecting members, thereby preventing shifting of the platform. The platform is conveniently made of wood but may also be made of metal, fiberglass, etc.. End sections 62 are preferably bolted to center section 60 as shown in FIG. 7, the entire arrangement being affixed to the ground by anchoring pins inserted through the platform into the ground (shown in FIG. 1). When used as a greenhouse, center section 60 and end section 62 may be omitted, leaving only the hub connecting members.

The simple construction of four bolts holding the platform together allows ease of construction, yet great structural integrity is insured because the platform fits tightly over the hub connectors and the protruding lower parts of hubs 12. Hubs 12 are cut in a wedge shape as viewed from above, the narrower central area dimensioned to fit under center platform section 60, and the hubs broadening approaching the upward extending portions thereof. By this means, any side-to-side motion of the platform relative to the hubs is precluded. Beneath the platform base 20, hubs 12 are connected to one another by cross members 61 shown in section in FIGS. 3 and 7, and in phantom in FIG. 4.

Figure 5:
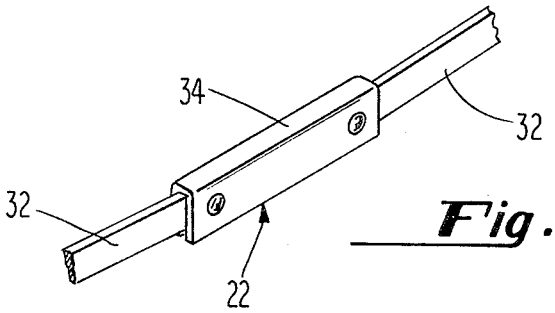
FIG. 5 is a perspective view of the Landau-type locking mechanism 22, also shown in FIGS. 1, 2 and 6.
Figure 6:
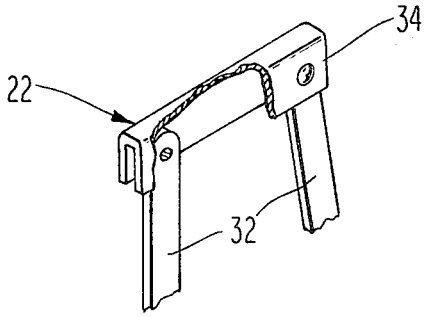
FIG. 6 is a cutaway view of locking mechanism 22, demonstrating the internal construction thereof.

The operation of Landau-type locking mechanism 22 is illustrated in FIGS. 2, 5 and 6. When opening the enclosure, a user merely presses outwardly on the center portion 34 of the lock mechanism 22. The lock being released, spring 24, mounted in opposition to lock mechanism 22, draws end joist 18 towards center joist 16, thereby opening the enclosure. Spring 24 is enclosed within flexible sheath 30 to minimize noise and scratching. The user may also choose to open the other side of the enclosure, however, the sides ae locked and may be opened and closed independently of one another. Handles 64 are preferrably provided on both sides of both end joists 18, for a total of four handles.

A Landau-type locking mechanism is known in the art, but may be briefly explained with reference to FIGS. 5 and 6. Center portion 34 is U-shaped in cross-section, having a closed outer edge and an open inner edge. Rivets pivotally affix center portion 34 to end portions 32. When lock 34 is closed as shown in FIG. 5, the edges of end portions 32 rest against the edge of center portion 34, allowing movement only slightly past parallel toward hub 12. When opened, center portion 34 allows legs 32 to pivot out of parallel, but in one direction only.

A primary benefit of the present invention is the ease with which the structure may be assembled. There are only six major elements plus nuts and bolts involved in construction. The parts list includes three bottom platform sections, two hub connecting bars, two hub plates, seven roof rods, one cover and two Landau-type hinge arms and opposing springs. Inasmuch as joists 14, 16, 18 are inserted directly into hub members 12, bolts or other such hardware are only required for the connecting members between the two hub members 12, and for mounting locking mechanism 22 and spring 24 to the joists. Since joists 24 are of spring-steel and hubs 12 of solid metal such as boiler plate or aluminum, each may be threaded, thereby relieving the user of the necessity of using nuts. Shoulder bolts are conveniently used to secure locking mechanisms 22 and springs 24; to secure the platform to the ground, two or more anchors are used. The center 34 of locking member 22 is conveniently secured to end sections 32 by means of rivets. Handles 64 may be attached to end joists 18 by rivets or by bolts.

The enclosure may be stored assembled, with the joists folded up and with the platform sections set on edge within the closed unit. Only as much floor space as required for hub flanges 12 is thus needed for storage.

It will be appreciated that an enclosure adapted for a single use may also be produced in accordance with this invention. Should the user desire a garage unit only, for example, the end platform segments can be adapted to perform the function of the relatively thin hub connector members described above. In such an embodiment, even fewer total parts would be needed because the end platform segments and the hub connector members would be one and the same.

Further variations on the inventive concept disclosed herein will now be apparent to those of ordinary skill in the art. Accordingly, reference should be made to the appended claims rather than the foregoing Specification as defining the true scope of this invention.

I claim:

1. A collapsible enclosure, comprising:

two central hub flanges having a plurality of joist holes along the periphery thereof;

at least one hub connecting member rigidly but detachably interconnectable between said hub flanges, said hub connecting member defining the width of said enclosure;

a plurality of joist members pivotably mountable between said hub flanges by insertion in said joist holes, the plurality of joist members comprising an inner support joist and a first outer support joist;

a locking mechanism pivotably connecting said inner support joist and said first outer support joist, said locking mechanism having inner and outer legs pivotal on said inner support joist and said first outer support joist respectively, and a locking flange pivotably connecting said inner leg and said outer leg, said legs being pivotable only in one direction;

a spring-like member attachable to and urging together said inner support joist and said first outer support joist;

a second outer support joist and at least one additional locking mechanism and spring-like member for connecting the second outer support joist and said inner support joist;

a covering skin mountable on said joist members and attached thereto at spaced intervals along said skin; and, a platform having a channel on a lower side thereof, said channel adapted to overfit said at least one hub connecting member interconnecting said two central hubs, whereby said enclosure is secured by the weight of said platform.

2. The enclosure of claim 1, wherein four locking mechanisms and spring-like members connect said inner support joist and said first and second outer support joists, two locking mechanisms on each side of said enclosure, and two on each end.

3. The enclosure of claim 1, wherein the channel on the lower side of the platform is also adapted to overfit at least a portion of said two central hubs, said hubs having a horizontally extending flanges at least as narrow as the channel at an inner end thereof, but wider than the channel beyond the portion of said hubs overfit by the platform, whereby the platform is secured against horizontal movement of the platform relative to the hubs.

4. The enclose of claim 3, wherein the horizontally extending flanges are wedge shaped, having a continuously increasing horizontal dimension from the inner end outwards.

5. The enclosure of claim 1, wherein said platform comprises a center section having said channel thereunder, and two end segments rigidly anchorable to the ground, said end segments being rigidly attachable to said center section.

6. The enclosure of claim 5, wherein said end segments are anchorable by means of at least one securing stake having an enlarged end, said stake adapted to be extended up to said enlarged end through said platform, whereby said platform may be anchored to underlying material.

7. The enclosure of claim 6, wherein said joist members are U-shaped and made of spring-steel.

8. The enclsoure of claim 1, wherein said covering skin is transparent, whereby said enclosure may be used as a greenhouse.

* * * * *